United States Patent [19]

Block et al.

[11] 3,997,107

[45] Dec. 14, 1976

[54] SERVO MODULATING REGULATING CONTROL SYSTEM

[75] Inventors: Leo Block, Westlake Village; Larry J. Ashton, Thousand Oaks, both of Calif.

[73] Assignee: Raypak, Inc., Westlake Village, Calif.

[22] Filed: Sept. 8, 1975

[21] Appl. No.: 611,077

Related U.S. Application Data

[63] Continuation of Ser. No. 457,598, April 3, 1974, abandoned.

[52] U.S. Cl. ..... 236/1 A; 137/118; 236/80 B; 431/60

[51] Int. Cl.[2] ..... F23Q 9/08

[58] Field of Search ..... 236/1 A, 80, 92 A, 82; 431/60, 61; 137/118, 98

[56] References Cited

UNITED STATES PATENTS

| | | | |
|---|---|---|---|
| 2,517,869 | 8/1950 | Grapp | 236/15 B X |
| 2,898,928 | 8/1959 | Kehoe | 137/80 |
| 3,123,298 | 3/1964 | Wolffe | 236/46 |

*Primary Examiner*—William E. Wayner
*Attorney, Agent, or Firm*—Herzig & Walsh, Inc.

[57] ABSTRACT

A servo valve control system exemplified by way of temperature controlled gas valves. Multiple slave pressure regulating valves are utilized supplying multiple burner manifolds. The first valve of the group of valves is modulated in response to temperature. The outlet pressure of each valve is utilized to bias and thereby modulate the next pressure regulating valve. The first valve, preferably is also controlled in response to an outdoor temperature sensor.

13 Claims, 11 Drawing Figures

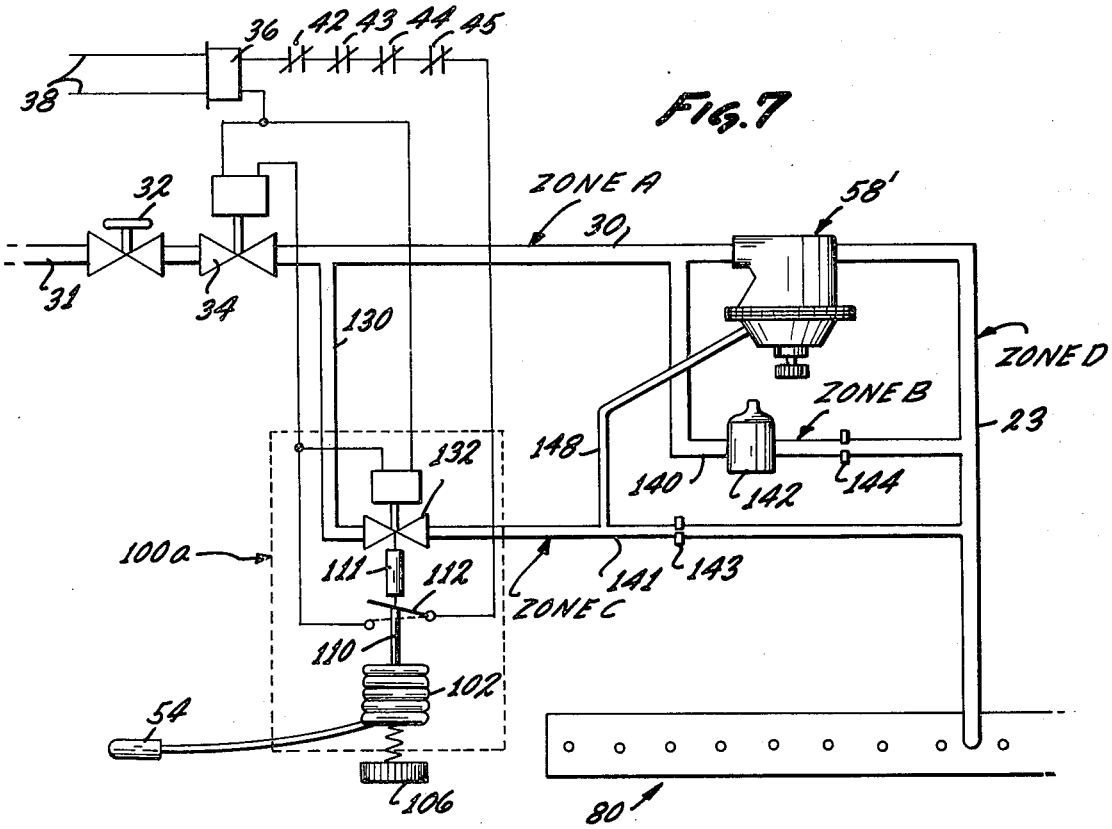

FIG. 7

FIG. 8

| PRESSURE | | | | | % FULL |
|---|---|---|---|---|---|
| CONDITION | ZONE A | ZONE B | ZONE C | ZONE D | RATE |
| NO CALL FOR HEAT 24V. VALVE, MASTER CONTROL + MOD. REG. ARE CLOSED. | 0 | 0 | 0 | 0 | 0 |
| BULB SENSES A SLIGHT DROP IN TEMP., MASTER CONTROL IS ENERGIZED + OPENS SLIGHTLY. 24V. SOL. VALVE ALSO ENERG. + OPENS. MOD. REG. CLOSED. | 5-9 IN W.C. DEPENDS ON GAS PRES. AVAIL. | 4 IN W.C. | .5 IN W.C | .18 IN W.C. | 20% |
| BULB SENSES ADDITIONAL SLIGHT DROP IN TEMP. MASTER CONTROL OPENS SLIGHTLY INCREASING PRESSURE IN ZONE D TO .7 IN W.C. MOD. REG. STARTS TO OPEN. | 5-9 IN W.C. | 4 IN W.C. | .7 IN W.C. | .20 IN W.C. | 21% |
| FURTHER DROP IN TEMP. MASTER CONTROL CONTINUES TO OPEN INCREASING BACK LOAD PRESSURE CAUSING MOD. REG. TO OPEN MORE. | 5-9 IN W.C. | 4 IN W.C. | 1.0 IN W.C. | .5 IN W.C. | 34% |
| CONTINUOUS DROP IN TEMP. MASTER CONTROL WIDE OPEN. MOD. REG. AT MAX FLOW RATE. | 5-9 IN W.C. | 4 IN W.C. | 4.6 IN W.C. | 4.0 IN W.C. | 100% |

SERVO MODULATING REGULATING CONTROL SYSTEM

This is a continuation of application Ser. No. 457,598 filed on Apr. 3, 1974, now abandoned.

SUMMARY OF THE INVENTION

The invention resides in improvements in automatic control and particularly in systems utilizing plural automatic valves. In the exemplary embodiments of the invention disclosed in detail herein, the invention is adapted in gas fired systems which may have multiple burner manifold sections and multiple valves automatically controlled in response to temperatures. However, the principles of the invention can be adapted in other types of systems.

Typically, in conventional gas fired systems, multiple burner manifolds or multiple burner manifold sections are employed with multiple valves. Commonly, the valves are relatively complex, expensive, temperature-responsive valves actuated in response to outlet temperature of a heating boiler, for example. Typically, these are relatively expensive controls involving components including potentiometers, bridge circuits, relays, transformers, and switches, some components requiring line voltage, and others operating on a step-down transformer voltage which is lower.

The system of the herein invention is calculated to make available means whereby effective control can be realized in systems of the type referred to by way of the use of considerably simpler and less expensive components, but which components nevertheless are ones which are already generally available.

With respect to prior art, reference is made to U.S. Pat. Nos. 2,899,135 and 3,064,900.

A feature of the herein invention is that the pressure-responsive valves used preferably are diaphragm-actuated, pressure-regulating valves which can be mounted in one form of the invention in an inverted position such that the weight of the valve stem and diaphragm act as a bias on the valve. The valve performs its particular function of regulating pressure. Additionally, a modulating gas pressure is applied to an opposite side of the diaphragm so that it modulates. This pressure is derived from the outlet pressure of a preceding valve in the system. The first valve of the group is modulated in response to temperature which may be temperature of the outlet line of a heating boiler, and it may be modulated in response to an outdoor temperature sensor as well.

A further improved feature embodied in the invention is the realization of a system wherein although multiple valves are utilized, there is only a single adjustment required to be made and set rather than multiple adjustments. The improvements in the system described above are in a system wherein there is a temperature adjustment by way of a knob only on the first valve which is responsive, for example to boiler outlet temperature.

In the systems of the type described, normally, additional controls are present which are typically electrical controls, which would include safety controls and a manually adjustable controller which requires setting in the area wherein the temperature is being controlled. The improvements of the herein invention make possible a system wherein there is only a single controller which requires a setting or adjustment. This is realized by way of control means whereby flow of gas to subsequent valves beyond the first tempeature-responsive valve is controlled in response to a pressure switch connected to the outlet of the temperature-responsive valve so that only after flow is established through this valve will there be flow to the subsequent valves.

The objects of the invention will be understood from the foregoing outline of the nature of the invention. In summary, the objects of the invention include, particularly, the effective utilization of pressure-regulating valves as modulating valves as well. Also, the realization of a system effectively using multiple-modulating, pressure-regulating valves modulated in response to outlet pressure of a preceding valve in the multiple. Also, in systems of this type, the capability of utilizing a manifold for the valves of particular construction as described hereinafter. A further object is to eliminate the need for complex electrical controls for multiple valves. A further object is to realize the above objectives in a system wherein the first valve of the multiple is a combined valve having a pressure regulating function and modulating functions in response to boiler outlet temperature and outdoor temperature and additionally having the function of automatically closing from a predetermined opened position.

BRIEF DESCRIPTION OF THE DRAWINGS

Further objects and additional advantages of the invention will become apparent from the following detailed description, wherein:

FIG. 7 is a schematic view of a further modified form of the invention;

FIG. 8 is a chart illustrating typical gas pressure relationships in the system of FIG. 7.

DESCRIPTION OF THE PREFERRED EMBODIMENTS

Figure 1:
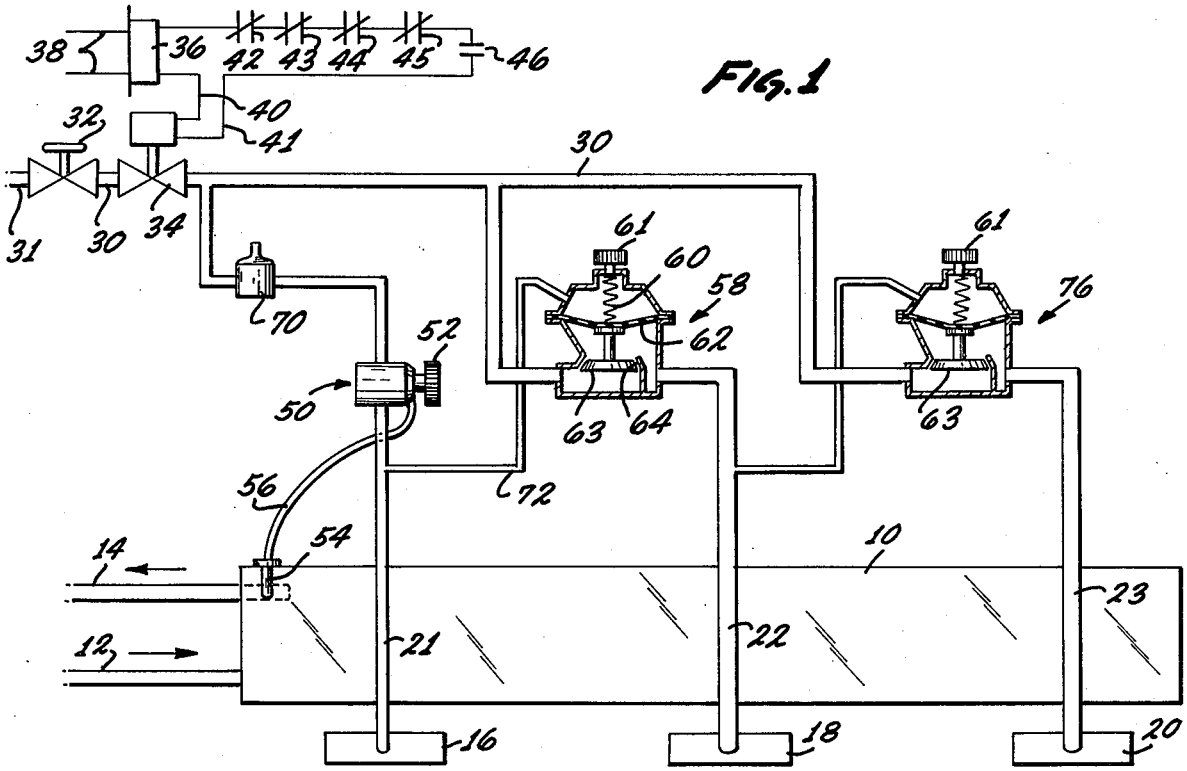
FIG. 1 is a schematic view of a preferred form of the invention.

In FIG. 1, a system is shown schematically embodying a heating boiler 10 having an inlet 12 and an outlet pipe 14. Three gas fired burner manifolds 16, 18, and 20 are shown which may be of conventional type and to which gas is supplied by pipes 21, 22, and 23. Gas is supplied to the burners from pipe 30 from line 31 having in it a manual shut off valve 32 and an electrical solenoid control valve 34. Numeral 36 designates a transformer to which power is supplied by line 38. The secondary winding of the transformer is connected to valve 34 by line 40–41. In this circuit are the typical controls which are shown diagramatically at 42, 43, 44, and 45, and a manually-adjustable, temperature-responsive control switch 46. This control includes the typical safety controls and other controls normally present in this type of system. Controls 42–45 may be controls such as a pilot safety, flow switch, low water cutoff, high temperature limit, etc.

In branch line 21 is temperature-responsive control valve 50 having adjusting knob 52. It is controlled by a thermostatic bulb 54 responsive to temperature in outlet line 14 from the boiler, this bulb being connected to valve 50 by capillary tube 56. Numeral 58 designates a conventional pressure regulator in line 22. Valve 50 opens automatically to a 20% flow position at a predetermined temperature, sensed by bulb 54.

Valve 58, structurally, may be a conventional pressure regulating valve. A conventional pressure regulator consists of a diaphragm that is exposed to reduced pressure on the underside and a spring force on the upper side. If the pressure downstream of the regulator is less than desired, the pressure acting on the underside of the diaphragm will exert a force less than the spring tension. This will cause the diaphragm to deflect in a downward direction. The valve disc is attached directly to the center of the diaphragm. The valve arrangement is constructed so that the valve opens when the disc is moved downward. The downward motion of the disc allows more gas flow and therefore, a greater pressure at the outlet of the regulator. This increase in pressure exerts a greater force against the diaphragm, causing it to move in an upward direction. An equilibrium position is achieved when the force exerted by the reduced pressure is equal to the force exerted by the spring.

As the demand for gas flow (cu. ft/minute) on the downstream side of the regulator changes, the pressure on the underside of the diaphragm also changes, and the diaphragm moves to open or close the valve until the pressure on the underside of the regulator again exerts a force equal to the force exerted by the spring.

In this invention, the tension is reduced on spring 60 by means of a screw adjustment 61 so that the spring exerts a minute force on diaphragm 62. The valve member is designated at 63 cooperating with seat 64. The pressure on the downstream side of the regulator will be typically approximately 0.20 inch W.C. In order to obtain increased pressure on the downstream side of the regulator, the upper cavity of the regulator is subjected to a pressure. This pressure on the upper side of the diaphragm exerts a force that works in unison with the spring force and causes the regulator to open. By increasing or decreasing the pressure in the upper cavity of the regulator, the regulator can be caused to open and close, thereby obtaining modulation as the pressure downstream of the regulator controls the actual gas flow to the burners.

The conventional modulating valve 50 can operate as the master of the servo system. In one mode of operation, at the time control instrument 46 opens valve 34, valve 50 is open, having been opened by bulb 54. Gas enters through manual on-off gas valve 32 and then flows through an electrically-operated gas solenoid valve 34. With this valve energized, gas flows through the upper distribution pipe 30. From pipe 30, the first gas flow is to the relatively small size gas pressure regulator 70 that limits the outlet pressure to approximately 4 inches W.C., and then to the direct-acting modulating valve 50. This modulating valve includes a bulb capillary tube and a bellows that is filled with a fluid as described with the bulb. located in the boiler outlet. If the bulb senses a drop in temperature, the fluid in the power element consisting of the bulb capillary and bellows reduces in volume, causing the bellows to contract. The contracting bellows opens the valve portion of the modulating valve and allows a greater amount of gas to flow to the primary burners. If the bellows element expands, it causes the modulating valve to reduce the gas pressure to the primary burners. In this manner, the gas flow to the primary burners is modulated to maintain a constant temperature in the boiler outlet. After this valve has modulated to reduce the gas flow to 20 percent of full capacity flow, it will suddenly snap to the completely closed position to prevent operation at gas flows of less than 20 percent of full rate flow. This valve may be one manufactured by Honeywell and is called MODUSNAP.

In normal boiler operation, modulating valve 50 is constantly adjusting the pressure to the main burners to maintain the boiler outlet temperature at a constant setting. FIG. 1 shows connecting tubing 72 between the outlet of modulating valve 50 and the upper cavity of regulator 58, that controls the gas flow to the second stage manifold 18. This regulator then becomes a slave to the modulating valve, which is the master of the servo system. When the modulating valve increases the gas pressure to the primary burners, this increase in pressure exerts a greater downward force on the regulator diaphragm 62, causing the regulator to increase the gas pressure to the second stage burners. The gas pressure in the second stage manifold then increases and decreases proportionally to the gas pressure in the first stage manifold. FIG. 1 also shows a third stage slave regulator 76 that controls pressure to the third stage manifold 23 on signal from the second stage manifold pressure in line 22. Its operation is like that of valve 58.

Basically, this invention consists in part of employing the use of a conventional modulating gas valve, which may be small in size to reduce cost, as a master of a servo system that controls the operation of a conventional gas pressure regulator so that this device now functions as a modulating control.

Heretofore, the only practical method of obtaining modulation on large atmospheric type boilers was by the use of multiple direct acting type valves, such as commercially known MODUSNAP valves or the use of a motorized modulating actuator to control the operation of a gas valve.

Boilers presently may employ the use of four or more such MODUSNAP valves in parallel and as many as six MODUSNAP valves may be used in parallel. A considerable cost is involved in fabricating a complex manifold for multiple valves. In addition to the substantial cost of the four valves and the high labor cost of fabricating the manifold, each of the valves has its own temperature control knob. Thus, the boiler installer or operator must properly position each knob in order to obtain satisfactory operation of the boiler. The herein invention has an advantage in this respect.

The conventional prior art modulating valve is a very expensive part to buy and also requires the use of a relatively expensive boiler outlet temperature controller. This temperature controller employs the use of a slide wire potentiometer and requires a three wire bridge circuit between the temperature controller and the actuator. The actuator must also be supplied with line voltage. An additional cost is a relay and transformer that is used in conjunction with the actuator and temperature controller. The temperature controller incudes a switch that de-energizes the actuator when the gas flow rate corresponds to twenty percent full rate flow. This switch presently (typically) can handle only 24 volts; whereas, the modulating actuator requires line voltage. Therefore, it is necessary to use a transformer and relay in this system.

The herein modulating regulator servo system provides a means of modulating the gas flow to large boilers by using only one modulating type valve and a relatively inexpensive gas pressure regulator. This system is much more economical to build than the above-described multiple arrangement or the motorized modulating actuator system.

In a second mode of operation of the system of FIG. 1, valves 58 and 76 are normally in a minimum open position. If valve 34 is opened by contacts 46 while valve 50 is closed, gas is supplied through pipe 30 to valves 58 and 76 which then regulate gas flows to manifolds 18 and 20. When valve 50 opens, operation is then as described above.

Figure 2:
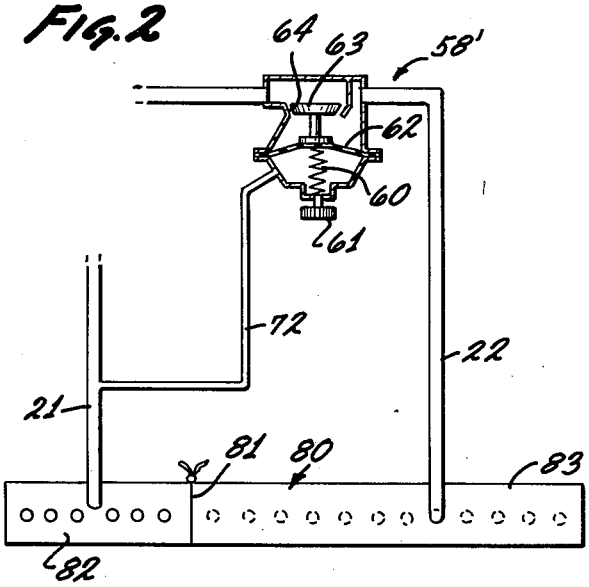
FIG. 2 is a partial view of a modified form of the invention showing a valve like that of FIG. 1, but with the valve in it in an inverted position.

FIG. 2 shows a modified arrangement wherein the controls are like FIG. 1, except as described hereinafter. However, there are not separate burner manifolds. There is a single burner manifold 80. In a typical construction, this manifold has a number of nozzles extending from its which direct flow of gas into individual burners. As shown, burner manifold 80 has a baffle or partition 81 in it. Pipe 21 connects to a smaller section 82 of the burner manifold. The reason for this is that when valve 50 first opens, limited flow (typically 20% of capacity) is insufficient for all the burners supplied by the entire manifold 80. As shown, pipe 21 supplies only the burners associated with section 82 of the manifold. FIG. 2 shows the simplest, least cost arrangement. Gas is admitted through a manual on-off valve and flows to a 24 volt gas solenoid valve 34 as in FIG. 1 whenever controller 46 demands heat. At the outlet of this solenoid valve, a small portion of the gas flows through a regulator 70 set at approximately 4 inches W.C. to master modulating gas valve 50 and then to the primary or master burners. The remaining gas at the outlet of the 24 volt gas solenoid valve 34 flows through slave modulating regulator 58' and then to slave burner manifold section 83. The small diameter tube 72 transmits the varying pressure on the downstream side of the modulating gas valve to the spring side of diaphragm 62. Twenty-four volt power is supplied by the transformer through the limit switch and other conventional safeties to the gas solenoid valve as in FIG. 1. The operating thermostat may be included in this circuit as shown at 46 in FIG. 1, or omitted.

Regulator 58' is installed in the inverted position. The purpose of this orientation is to allow the weight of diaphragm 62 and the diaphragm plate which is significant on larger size regulators to oppose the force generated by spring 62. If the regulator were installed in its normal position, the weight of these components would exert a force that would be additive to the spring force, and the low pressure at the outlet of this regulator which is required for a 20 percent full rate flow would not be obtained. The inverted position allows the gravity force of the components to cancel out most of the spring force so that a conventional spring can be used to obtain the desired low outlet pressure.

The operation of the system shown in FIG. 2 is as follows. The operation is like the second mode described in connection with FIG. 1. Valve 58' is normally in a minimum open position. When operating thermostat 46, which may be located in a hot water storage tank or in the hot water distribution piping of a HYDRONICS system calls for heat, it closes the contacts. The 24 volt gas solenoid valve 34 is energized. Gas flows through modulating gas regulator 58' to the slave burner manifold 83. Because the modulating gas valve 50 is still in a closed position, the pressure on the underside of the diaphragm is still at atmospheric, and the only force on the diaphragm is the net spring force. Thus, the gas pressure at the outlet of this regulator is typically approximately 0.20 inch W.C., and the slave burners ignite and operate at 20 percent of their full capacity. If the amount of heat supplied by the slave burner operated at 20 percent of full rate is insufficient, the temperature at the boiler outlet will drop below the setting of the control knob of master modulating gas valve 50, and valve 50 will open. When valve 50 opens, gas is admitted to master burner manifold 82; and this same gas pressure is exerted on the underside of modulating regulator diaphragm 62, causing the modulating regulator to increase the gas pressure to the slave burners. When the temperature of the boiler outlet water exceeds the setting of the control knob on master modulating gas valve 50, this valve will snap shut; and the pressure in the master burner manifold will become atmospheric. At this point, modulating regulator 58' will be positioned only by the net spring force and will provide 20 percent full rate gas flow to the slave burner. This rate of operation will continue until the master modulating gas valve again opens or operating thermostat 46 is satisfied. When operating thermostat 46 is satisfied, the contacts will open; and the 24 volt gas solenoid valve will close, shutting off all gas flow.

In FIG. 2, a single modulating regulator 58' is shown, although there may be additional stages.

The above system has two adjustable temperature control points, i.e., knob 52 and control instrument 46. Temperature control knob 52 on the master modulating gas valve must be set for each corresponding setting of the operating thermostat 46. The settings need to set to be compatible.

Figure 3:
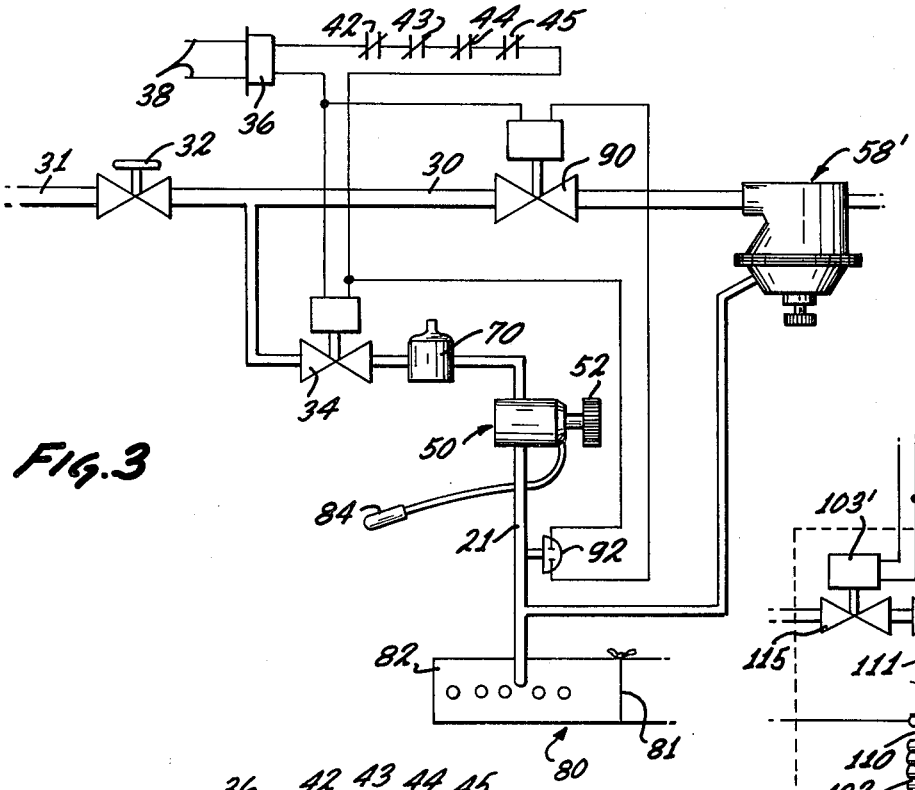
FIG. 3 is a schematic view of a modified form of the invention.

The system of FIG. 3 eliminates the disadvantage of the single gas valve system. Modulating regulator 58' is installed in the inverted position. Two separate gas solenoid valves are used. A small valve 34 is used on the gas line feeding the modulating gas valve 50, and a large gas solenoid valve 90 is used on the gas line feeding modulating regulator 58'. A pressure switch 92 is located on the outlet side of the modulating gas valve. An operating thermostat in the 24 volt circuit is not required. The limit switch and other safeties are located in this circuit, and the small gas solenoid valve is normally always energized.

The operation of the system is as follows. When the boiler outlet water temperature drops below the operating temperature established by the position of the modulating gas valve temperature control knob 52, master modulating gas valve 50 opens. Opening of valve 50 allows gas to flow to master burner manifold 82 and also to close pressure switch 92. Valve 34 is normally energized and open as stated above. Closing of the pressure switch energizes the large 24 volt gas solenoid valve 90. When energized, valve 90 allows gas to flow to modulating regulator 58: and to the slave burner manifold. The pressure in the slave burner manifold is determined by the net spring force of the regulator and the pressure on the underside of the diaphragm, which is the same pressure as in the master burner manifold as in FIG. 2. As master modulating gas valve 50 opens and closes, on signal from the temperature sensing bulb located in the boiler outlet, modulating regulator 58: provides a corresponding pressure in the slave burner manifold. When the boiler outlet temperature increases above the master modulating gas valve knob setting, the modulating gas valve snaps shut. When the maste modulating valve closes, the pressure in the master burner manifold drops to atmospheric causing the pressure switch to open and de-energize the large 24 volt gas solenoid valve 90. When valve 90 is de-energized, gas flow to slave burner 82 is stopped. The major advantage of this system is that temperature control is requlated only by knob 52 on the master modulating gas valve. The control 46 of FIG. 1 which might be a room thermostat or boiler water thermostat is not present.

Figure 4:
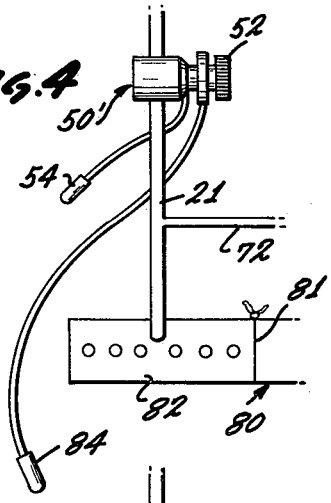
FIG. 4 is a partial view of a modified form of the invention, which is like that of FIGS. 1 or 2 with an additional outdoor temperature responsive sensor.

FIG. 4 shows an extra power element attached to the modulating gas valve in a system like that of FIGS. 1 or 2. However, the setting of the control knob must be compatible with the setting of the operating thermostat in the 24 volt circuit.

Figure 5:
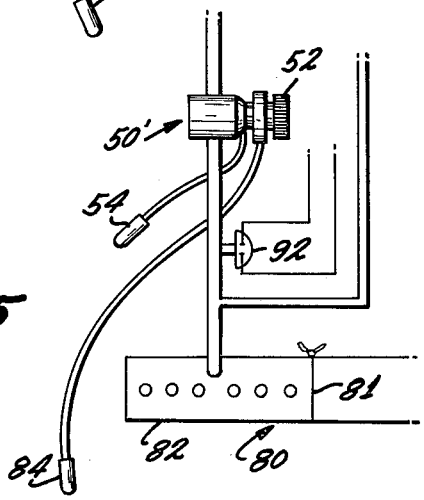
FIG. 5 is a partial view of a modified form of the invention which is otherwise like that of FIG. 3 but additionally embodies an outdoor temperature responsive sensor.

The system of FIG. 3 can also be used to provide outdoor reset control with both the single gas valve and the double gas valve arrangement. For outdoor reset control, an additional power element is added to the master modulating valve as shown in FIG. 5. Bulb 84 of this power element is installed outside the building so that it senses outside air temperature. This additional power element resets the master modulating valve so that the boiler outlet water is maintained at a lower temperature when the outside ambient temperature is relatively high. Conversely, when the outside air temperature drops, this extra power element resets the master modulating gas valve to provide a higher boiler outlet water temperature. The higher boiler outlet water temperature increases the capacity of a building heating system as a greater amount of heat is transferred through fan coil units and convectors to the air inside the building. In this manner, outdoor reset control adjusts the capacity of the building heating system to the outdoor demand. All temperature adjustment is carried out by the control knob 52 on the master modulating gas valve 50:. This is the preferred system.

The above discussion describes a conventional regulator in which the diaphragm controls a conventional disc and seat arrangement. On large size boilers, a low pressure drop type regulator is normally used. In this type regulator, a conical valve disc moves downward to increase the rate of flow between a chamfered inlet pipe and outlet pipe. This modulating regulator concept is also applicable to this low pressure drop type regulator. This low pressure drop regulator is also mounted in the inverted position to allow the weight of the diaphragm and diaphragm plate to oppose the spring force.

Figure 6A:
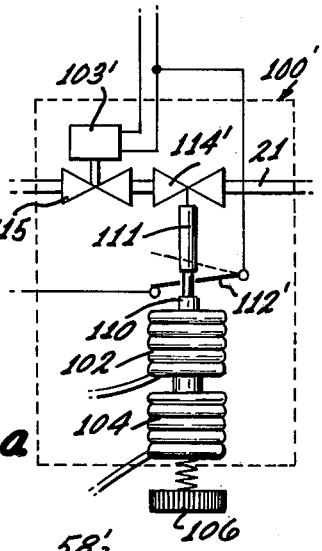
FIG. 6*a* shows a slightly modified version of FIG. 6.
Figure 6:
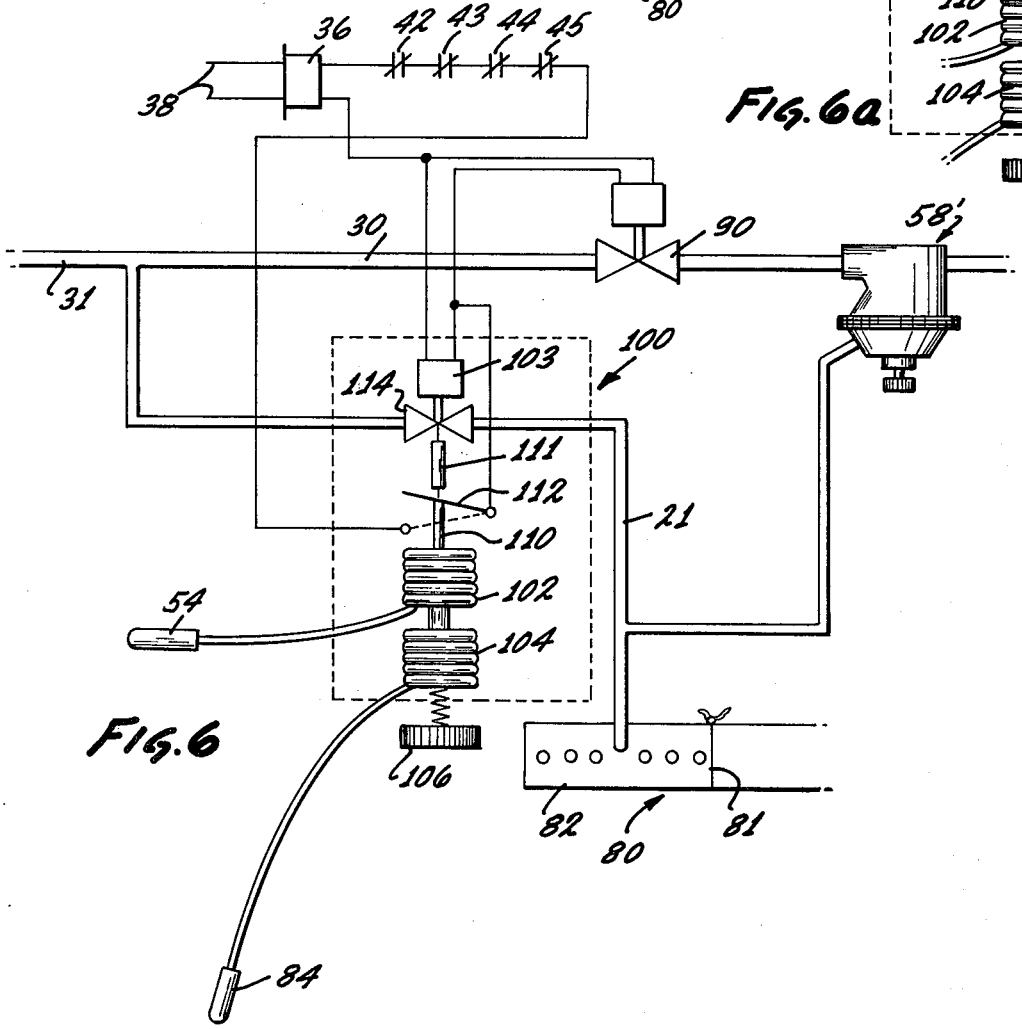
FIG. 6 is a schematic view of a modified form of the invention which otherwise is like FIGS. 1 or 2, but wherein the first valve is a combined pressure regulating and temperature responsive valve, responsive to boiler outlet temperature and outdoor temperature and embodying a snap closing feature.

FIG. 6 shows a modified form of the invention which is similar to previous embodiments, except as described hereinafter. Parts which are the same as previous forms or systems are identified by the same reference numerals. The principal difference in this system is that the master modulating valve is a combination type of valve responsive to boiler water temperature, outdoor temperature and also having a pressure regulating function and embodying a switch which is actuated at the time that the valve initially opens to cause opening of solenoid valve 90. The combination valve is designated as a whole by numeral 100. It embodies bellows element 102 and 104 controlled by thermostatic bulb 54 and 84 like those previously described. The control point is adjustable by knob 106. The bellows elements have stem 110–111 which can actuate switch 112 which is in circuit with valve 90. The valve itself is designated diagrammatically at 114 and is modulated through stem 110–111.

Numeral 103 is a solenoid winding normally controlled in response to switch 112 and elements 102 and 104. The switch closes on a drop in temperature, energizing the solenoid valve 103. Controls 42–45 are like those in previous embodiments.

Normally, solenoid 103 is controlled by switch 112 in response to the power elements, by way of example, one being responsive to boiler water outlet temperature and the other to outdoor temperature. Of course, only one power element may be used if desired. After valve 103 opens, it is modulated by the bellows element or elements. Alternatively or optionally instead of this composite valve, a separate solenoid valve in series with a separate modulating valve may be employed. The operation, otherwise, is the same, the switch 112 operating similarly. The valve 100 may be the composite valve identified as G57 of Penn Basso Company. The system of FIG. 6 is similar to that of FIG. 3, except that switch 112 causes actuation of valve solenoid 103 and valve 90. Valve 100 also performs the same function as a pressure regulator.

FIG. 6*a* shows an alternate version 100: of the composite valve set up of FIG. 6. A separate solenoid valve 115 is provided in series with valve 114:. Valve 114: is modulated as in FIG. 6, but the solenoid 103: operates valve 115. Switch 112: is operated by stem 110.

The system of FIG. 7 is similar to that of FIG. 6, except as follows. The baffle or partition in gas manifold 80 is omitted.

In FIG. 7, there is branch line 130 from line 30 to a solenoid-operated valve 132 which is a combined valve operable by bellows 102 and bulb 54 and having an adjusting knob 106. Difficulty may be encountered in obtaining 20% of full rate operation because this requires regulator 58: to provide a pressure in the manifold of typically 0.18 inch water column at the time the regulator opens. The regulator may open within the range of for example, 0.17–0.25 inches. Also in closing, the exact shut off pressure may vary within this range. The minimum bypass rate arrangement was evolved as an improvement.

In FIG. 7, regulator 58: connects to the burner manifold through line 23. Numeral 140 designates a bypass line having in it a minimum rate regulator 142 and a minimum rate orifice 144. Valve 132 connects to line 23 through line 141 having in it minimum rate orifice 143. Line 148 connects the discharge pressure of valve 132 to the diaphragm of valve 58:.

The operation of FIG. 7 to the extent that it is different from the previous embodiment is as follows. Regulator 58: is adjusted so that it still remains closed when master combination control valve 132 first opens.

Valve 34 opens at the same time as master combination control 100*a*, and it supplies gas to regulator 58' which is still closed and to minimum rate regulator 142 which provides a constant 4 inch pressure to minimum rate orifice 144 by way of example. The minimum rate orifice, for example, is sized to provide 0.18 inches water column pressure in manifold 23. This pressure corresponds to 20% of full rate. In this manner, a finite method is realized of obtaining 20% full rate which is independent of the calibration of regulator 58' because the regulator is closed when the master valve 132 first opens.

Upon an additional demand for heat, the master modulating control moves to a further open position, thereby increasing the pressure to the spring side of the diaphragm and modulating regulator 58'. The regulator now opens and provides a greater pressure. Thus, there is a greater rate to manifold 80. An exact calibration of the regulator is not required because a difference of 0.1 to 0.2 inches pressure in the opening of the regulator. is not significant.

In order to insure a flow of gas through the master modulating control 132, leak off or bleed orifice 143 is provided. This orifice is to provide, for example, 0.18 inches water column pressure on the downstream side of the orifice when the upstream side of the orifice is at 0.5 inches water column. This leak off arrangement provides the necessary gas flow through master control 132 and eliminates the need for a separate master manifold section. This reduces the manufacturing cost of the manifold.

FIG. 8 illustrates an exemplary step by step sequence of events starting from a completely off position to a full rate position. The chart (FIG. 8) identifies four zones which are indicated on FIG. 7. When master modulating valve 132 opens, it supplies a pressure of 0.5 inches to the spring side of the diaphragm in regulator 58'. However, this 0.5 inches of pressure is not sufficient to open the regulator. When there is an additional call for heat, master modulating valve 132 moves to a more open position, providing a greater downstream pressure, and regulator 58' first starts to open when the pressure of the spring side of the diaphragm obtains approximately 0.7 inches of water column.

A particular advantage of this arrangement is that master combination control 132 can be the smallest size available which promotes economy. The gas flow through this control is used only to supply the necessary pressure to the spring side of the diaphragm in valve 58' to control its operation.

Figure 6B:
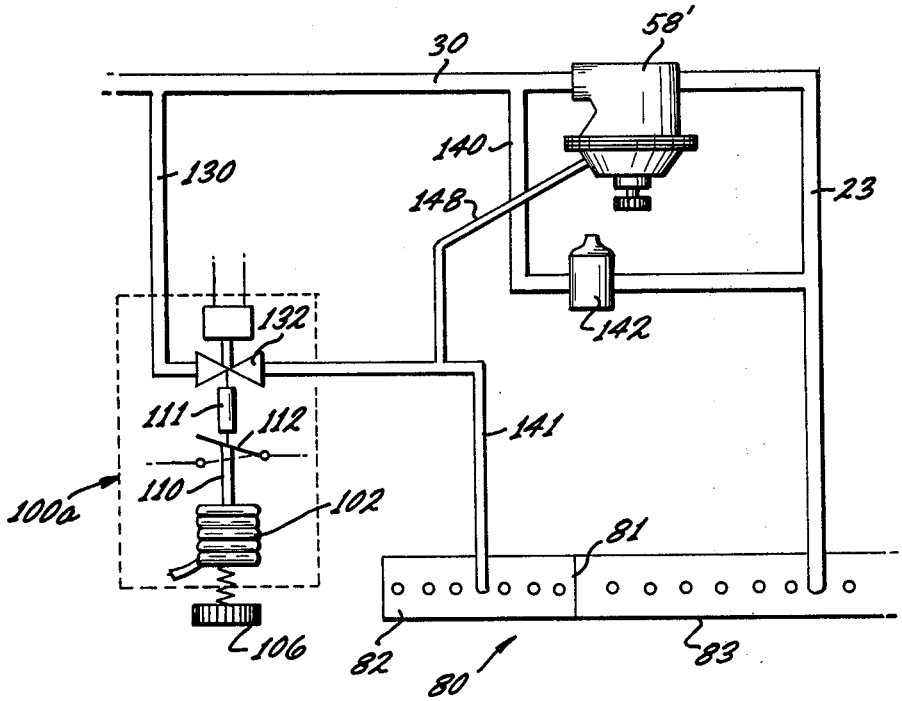
FIG. 6*b* shows a slightly modified version of FIG. 6.

FIG. 6*b* is similar to the system of FIG. 6, except that it has regulator 142 of FIG. 7 across valve 58'. Manifold partition 81 is provided. This insures adequate operation at 20% full rate. This makes it unnecessary to have a modulating regulator with precise opening characteristics.

Figure 7A:
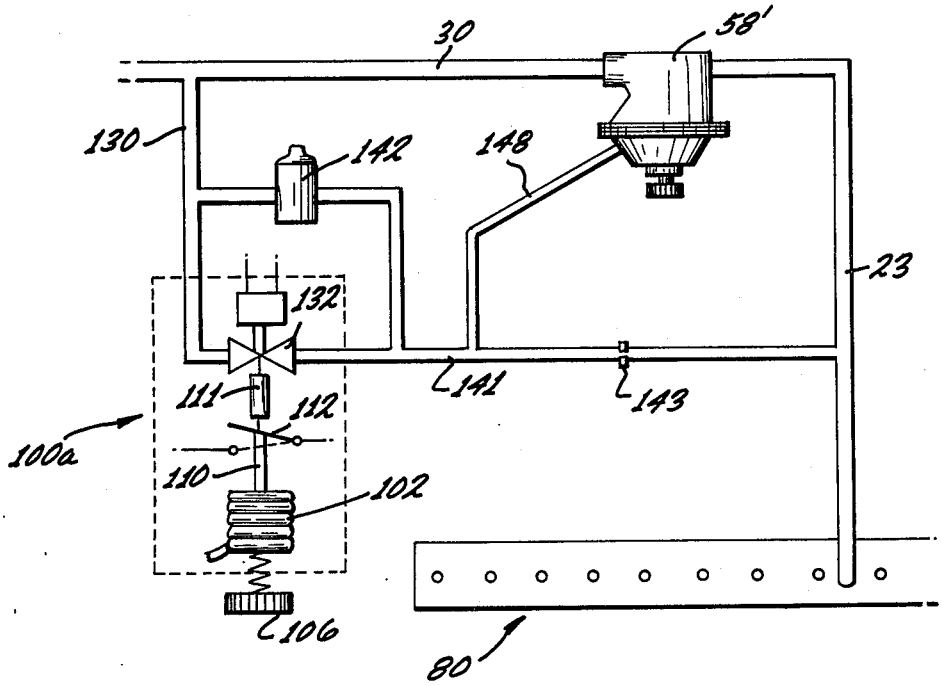
FIG. 7*a* shows a slightly modified version of FIG. 7.

FIG. 7*a* shows a system which is a modification of that of FIG. 7. The minimum bypass regulator 142 is set to deliver 0.5 inches water column pressure. The outlet of this regulator connects to the outlet of the modulating combination control 100*a*. Controller 100*a* is set to provide 0.5 inches water column pressure when it first opens. There is only a single orifice 143 which is in the line 141. The full flow through minimum bypass regulator 142 and controller 100*a* passes through this orifice.

In this system, in the event that the solenoid valve forming part of the composite control 100*a* should fail in the closed position and bulb 54 senses a call for heat, then bypass regulator 142 will provide all of the flow necessary to maintain the 20% full rate. This is an improvement over the arrangement of FIG. 7, wherein if the modulating combination control valve failed in the closed position, there could be a flow rate of less than 20% of full capacity.

From the foregoing, those skilled in the art will readily understand the nature of the invention and will appreciate the exact manner in which it achieves and realizes all of the objectives as set forth in the foregoing, as well as its many advantages.

The foregoing disclosure is representative of preferred forms of the invention and is to be interpreted in an illustrative rather than a limiting sense, the invention to be accorded the full scope of the claims appended hereto.

What is claimed is:

1. In a fluid flow regulating system such as a system for supplying gas to a gas burner, in combination: burner means, flow control means incuding a condition responsive modulating valve controlling a primary flow of gas to the burner means; additional flow control means comprising a pressure regulator controlling a second parallel flow to the burner means, and means connecting the discharge pressure from the modulating valve to the regulator to provide a biasing influence whereby said pressure regulator is modulated in response to said pressure thereby acting as a slave to the modulating valve.

2. A system as in claim 1, including a second modulating pressure regulator controlling flow to the burner means having connection to the discharge pressure from the first modulating pressure regulator whereby it operates as a slave also.

3. A system as in claim 1, wherein said pressure regulator is set to be in a normally open position whereby to supply gas in response to a second condition when the modulating valve is not open.

4. A system as in claim 1, wherein said pressure regulator embodies a diaphragm chamber including a diaphragm, said pressure regulator being inverted whereby the weight of the valve and diaphragm act in closing direction of the valve.

5. A system as in claim 1, including a burner manifold, said manifold having a partition in it, said modulating control valve being connected on one side of the partition and the slave modulating regulator valve connected on the other side of the partition.

6. A system as in claim 1, including an electrical control valve in series with said modulating pressure regulator, and control means responsive to opening of the modulating valve for opening said control valve.

7. A system as in claim 6, including a control element responsive to pressure on the downstream side of the modulating control valve controlling said electrical valve whereby after opening of said modulating control valve, the electrical valve is caused to open, supplying pressure to the modulating pressure regulator.

8. A system as in claim 6, wherein said modulating control valve is a type of valve embodying switch means responsive to a condition being controlled for controlling said electrical control valve.

9. A system as in claim 7, including a further electrical control valve in series with said modulating valve, and means whereby said last mentioned electrical control valve is also controlled by said condition being controlled.

10. A system as in claim 1, including a bypass line which bypasses said modulating pressure regulator and means including a minimum rate pressure regulator in said bypass line for establishing an accurate initial minimum rate of flow.

11. A system as in claim 10, including a minimum rate orifice beyond said minimum rate pressure regulator.

12. A system as in claim 11, including a minimum rate orifice in the discharge line of said modulating control valve.

13. A system as in claim 11, including a second minimum rate orifice in the discharge line of said modulating control valve.

* * * * *